US008144077B2

(12) United States Patent
Dain

(10) Patent No.: US 8,144,077 B2
(45) Date of Patent: Mar. 27, 2012

(54) VISUAL DISPLAY STRUCTURE WITH FADE RESISTANT SURFACE FINISH

(75) Inventor: Susan Dain, Montrose, CA (US)

(73) Assignee: Disney Enterprises, Inc., Burbank, CA (US)

( * ) Notice: Subject to any disclaimer, the term of this patent is extended or adjusted under 35 U.S.C. 154(b) by 903 days.

(21) Appl. No.: 12/042,866

(22) Filed: Mar. 5, 2008

(65) Prior Publication Data

US 2009/0225003 A1 Sep. 10, 2009

(51) Int. Cl.
*G09G 1/06* (2006.01)

(52) U.S. Cl. ..... 345/10; 264/313; 249/127; 249/55

(58) Field of Classification Search ..... 345/10, 345/418

See application file for complete search history.

(56) References Cited

U.S. PATENT DOCUMENTS

| | | | | |
|---|---|---|---|---|
| 3,552,988 | A | 1/1971 | Boiardi | |
| 4,036,929 | A | 7/1977 | Gould | |
| 4,466,937 | A | 8/1984 | Johnston et al. | |
| 5,047,187 | A | 9/1991 | Banus | |
| 5,860,876 | A | 1/1999 | Guffey et al. | |
| 5,887,399 | A | 3/1999 | Shaw et al. | |
| 6,033,146 | A | 3/2000 | Shaw et al. | |
| 6,403,004 | B1 | 6/2002 | Stecker | |
| 6,491,852 | B1 | 12/2002 | Sedaka | |
| 6,770,328 | B1 * | 8/2004 | Whaley | 427/407.1 |
| 7,285,238 | B2 * | 10/2007 | Buchenroth et al. | 264/313 |
| 2006/0083591 | A1 | 4/2006 | Shaw et al. | |

FOREIGN PATENT DOCUMENTS

| | | |
|---|---|---|
| DE | 19755626 | 6/1999 |
| WO | WO 99/05075 | 2/1999 |

* cited by examiner

*Primary Examiner* — Kevin M Nguyen
*Assistant Examiner* — Kenneth B Lee, Jr.
(74) *Attorney, Agent, or Firm* — Farjami & Farjami LLP

(57) ABSTRACT

Methods and apparatuses for a visual display structure having a fade resistant surface finish. The visual display structure is three-dimensional and may be used to recreate a naturally occurring structure, such as rocks, coral or vegetation. The visual display structure may also be used to produce a scenic element, such as an underwater castle, sunken ship or ruins. The visual display structure is created by providing a base, a binder over the base, and crushed glass particles to the binder. The crushed glass particles may be selected from a plurality of colors and are arranged so as to imitate the naturally occurring structure and its surface features. Once the crushed glass particles are applied to the base, thereby assuming the shape of the base, the visual display structure is ready for use. The visual display structure may be exposed in part to an underwater environment as, for example, a component in a theme park attraction.

20 Claims, 4 Drawing Sheets

VISUAL DISPLAY STRUCTURE WITH FADE RESISTANT SURFACE FINISH

BACKGROUND OF THE INVENTION

1. Field of the Invention

The present application relates in certain embodiments to methods and apparatuses for creating a visual display structure with a fade resistant surface finish. In particular, embodiments of the present application relate to methods and apparatuses using crushed glass particles to form a visual display structure designed to imitate a naturally occurring structure or produce a scenic element that can be used in an underwater, chlorinated environment or in other environments.

2. Description of the Related Art

Man-made visual displays have been used for many years and serve many different purposes. Visual displays may include both two dimensional works, such as signs and billboards, and three dimensional works, such as statues. Visual displays serve multiple purposes. For example, while signs and billboards are designed to convey information to an observer, statues may be designed for decorative purposes around libraries, schools and other public places.

Man-made visual displays are found everywhere, from dense urban cities to rural farmlands to municipal parks. In particular, amusement park grounds offer a high concentration of visual displays designed to attract and entertain children and adults who have paid a fee to gain admittance into the park. Visual displays that may be found in amusement parks include murals, statues of famous cartoon characters, replicas of famous landmarks such as the Eiffel Tower or the Golden Gate Bridge, artificial structures such as sunken ships and man-made ruins, and structures designed to recreate and imitate structures found in nature, such as ice, snow, mountains, coral, and trees. These visual displays may be used in different locations throughout amusement park grounds, including above ground and underwater. Occasionally, a visual display may be exposed partly above ground, while the rest of it may be submerged underwater.

How a visual display is made often depends on the purposes of the visual display. For example, the purpose of a stop sign is to halt traffic and provide safety to pedestrians at any time of the day. The sign must be made of a material that can withstand outdoor elements such as wind and rain. The sign must be large enough so that the word STOP can be painted on the sign, and specific paints must be chosen such that the sign will be visible, reflective and non-corrosive.

Similarly, just like the example of the stop sign above, how a visual display is made will depend on the purpose of the display. For visual displays designed to recreate and replicate other objects (such as cars, animals, and landscapes), such as for decorations on amusement park rides, the purpose of these displays may be primarily aesthetic, and it is important that the displays resemble the objects that they are trying to imitate. These visual displays are often made to resemble the objects by painting the surface of the display so as to depict all of the surface features of the object to be imitated.

Visual displays may rely on multiple paints in order to resemble the object to be imitated. For example, latex and oil-based paints may be used specifically for outdoor visual displays because the paints exist in many colors, are easily available, inexpensive and are able to withstand wear and exposure to severe weather conditions. For visual displays that may be used underwater, such as in swimming pools or water-themed attractions at amusement parks, chlorinated rubber paints, such as polyvinyl chloride paints, may be applied on top of a base to make a visual display that may, for example, resemble a natural underwater structure such as rock, coral or vegetation.

Although the use of paint is a common and simple way to make a visual display resemble a natural structure, the use of paint also presents multiple disadvantages. For outdoor visual displays that use paint, the visual displays are often exposed to full sun exposure, which causes the paint to fade over time due to photodegradation caused by the sun's ultraviolet rays. Because of color fading, the visual display must be repainted or refinished numerous times throughout the display's lifetime use, which can be expensive and time consuming. Similarly, visual displays that are placed at least partially in underwater environments, such as in pools or amusement park attractions, are also subject to color fading due to possible exposure to a chlorinated environment. The average chlorine concentration in pools may be on the range of about 0.5 to 5 parts per million, while the concentration may be even higher in other environments, such as in underwater components of amusement park attractions, resulting in continuous fading.

Due to the continuous fading, underwater visual displays may need to be constantly repainted and refinished, which may require the additional effort of removing the displays from the underwater environment. For visual displays that may be grounded and fixed in an underwater environment, such as in a man-made lake or lagoon, water may need to be drained before the displays are repainted and refinished. For underwater visual displays that are painted, the fading process can be a noticeable problem within only about one year of making the display, depending on the exposure to sunlight and possible chlorination of the water. In some environments, the repainting and retouching process for visual displays may take place one or more times per year.

Some paints may also be considered unsuitable for the environment and may be too toxic to pass environmental standards set up by government agencies. For example, the South Coast Air Quality Management District (AQMD) is an air pollution agency responsible for regulating stationary sources of air pollution in several counties of California. The agency is responsible for developing, adopting and implementing Air Quality Management Plans for the counties, and its plans must be complied with by many businesses, including amusement parks located throughout Southern California. As such, it is important that these businesses comply with the standards set by the AQMD, and other agencies, by using environmentally friendly materials that comply with regulatory standards.

SUMMARY OF THE INVENTION

It is thus an object of the present application to provide a visual display structure with a fade resistant surface finish that alleviates the aforementioned problems. The visual display structure will preferably be fade resistant against UV rays and chlorination, and will preferably be environmentally friendly and compliant with environmental standards.

In accordance with one embodiment of the present application, a method is provided for imitating a natural underwater structure in a chlorinated environment. The method comprises providing a base in a desired shape of the natural underwater structure to be imitated. Crushed glass particles are applied to the base with epoxy, wherein the crushed glass particles are selected from a plurality of colors arranged to imitate the natural underwater structure, the crushed glass particles assuming the shape of the underlying base. At least a part of the base with epoxy is exposed to an underwater, chlorinated environment.

In accordance with another embodiment of the application, a method is provided for creating an underwater display. The method comprises providing a base having a desired three-dimensional shape and adhering crushed glass particles to the base, wherein the crushed glass particles are selected from a plurality of colors arranged to imitate a natural underwater structure. At least a part of the base with crushed glass particles may then be exposed in part to an underwater environment.

In accordance with another embodiment of the application, an underwater display structure that imitates a natural underwater structure is provided. The underwater display structure comprises a base in a desired shape of the natural underwater structure to be imitated, a layer of epoxy applied to the base, and a plurality of crushed glass particles applied to the epoxy. The crushed glass particles are selected from a plurality of colors arranged to imitate the natural underwater structure and assume the shape of the underlying base to imitate the natural underwater structure.

In accordance with another embodiment of the application, a method is provided for producing a scenic element as part of a visual attraction. The method comprises providing a base having a desired three-dimensional shape and adhering crushed glass particles to the base, wherein the crushed glass particles are selected from a plurality of colors arranged to produce a desired scenic element.

In accordance with another embodiment of the application, a composition is provided. The composition comprises a carrier such as epoxy with crushed glass filler.

DETAILED DESCRIPTION OF THE PREFERRED EMBODIMENTS

Embodiments of the present application relate to methods and apparatuses for creating visual display structures. In one embodiment, the visual display structures imitate naturally occurring structures and their surface features. "Naturally occurring structures" may include any structures found in nature that are not man-made. The structures may include for example, but are not limited to rock, coral, sand, ice, snow, stars, algae, trees and other types of vegetation. Embodiments of the present application may be particularly beneficial to imitating natural underwater structures, which may include any of the structures identified above or other structures, including, but not limited to, rock, coral, sand, ice, snow, algae, trees and other types of vegetation.

In some embodiments, the visual display structure may serve to create a scenic element of a larger scene or production, such as in an amusement park display or attraction. More preferably, the visual display may be used to imitate a desired scenic element. The term "scenic element" may include but is not limited to naturally occurring structures and man-made structures found above ground or underwater, for example such things as an underwater castle, a sunken ship, man-made ruins, a spaceship, building structures, cartoon characters, and artificial living structures such as oversized animals. For example, in one embodiment, a visual display structure may be used to imitate a snow-capped mountain as part of a larger scene of mountain ranges. One or more scenic elements may be produced as desired and may depend on the overall theme of the scene to be produced. In one embodiment, a visual display designed to produce a scenic element may be submerged completely underwater. In yet another embodiment, a visual display structure may also serve as a mural or mosaic in an underwater environment.

Figure 1:
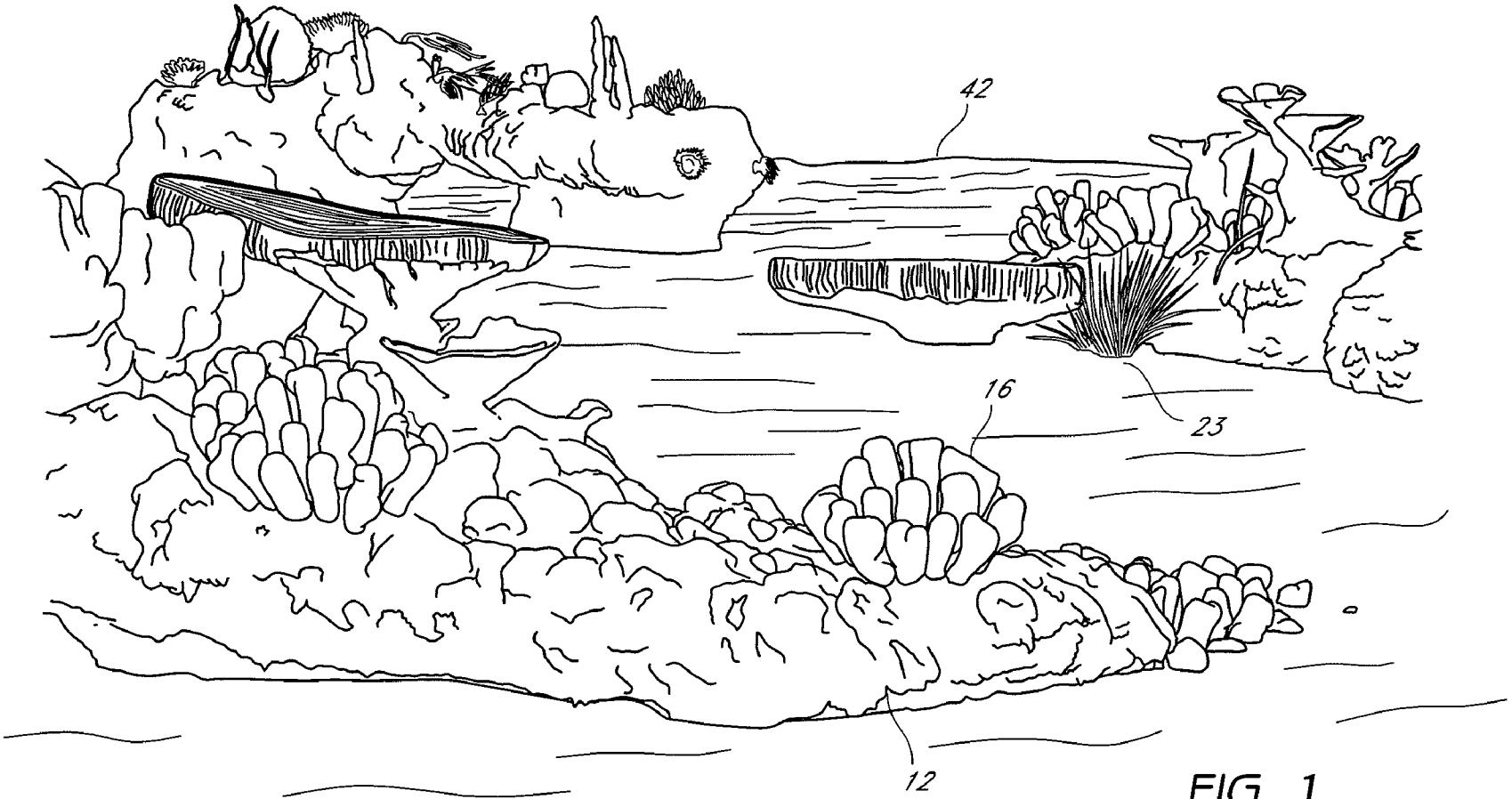
FIG. 1 illustrates a schematic view of a man-made lagoon having visual displays designed to imitate vegetation, rock and coral.

FIG. 1 illustrates a schematic view of a man-made lagoon having visual displays according to one embodiment of the present application designed to imitate rock, coral and vegetation. Such man-made lagoons may be found, for example, in tropically themed-hotels or on amusement park grounds as a stand-alone display or component in a themed attraction. Although the man-made lagoons are generally found outdoors, some man-made lagoons may also be found indoors. For outdoor man-made lagoons, these lagoons may be exposed to continual sunlight and ultraviolet radiation.

The man-made lagoon of FIG. 1 comprises a plurality of visual displays designed to imitate rocks 12, coral 16 and vegetation 23, surrounded by a pool of water 42. In one embodiment, the visual displays may be located above water. In another embodiment, and as shown in FIG. 1, the visual display may be located partly above water and partly submerged in an underwater environment. In yet another embodiment, and as shown in FIG. 2, the visual display may be completely submerged in an underwater environment.

The visual displays of FIG. 1 are designed to imitate natural structures and their surface features, and may assume many different shapes and sizes, depending on the structure to be imitated. For example, the visual display of rocks 12 is curved and has jagged edges. The visual display of coral 16 includes a colony of cylindrically shaped "heads" that have cross-sections of varying diameters. And the visual display of vegetation 23 includes numerous fronds or blades of varying height. Although the visual displays of FIG. 1 assume shapes and sizes of naturally occurring structures as are typically found in nature, the skilled artisan will appreciate that the visual displays of the present application may assume shapes and sizes beyond those as would normally be expected in nature. For example, the visual displays may be made oversized and much larger than a real-life naturally occurring structure.

The visual displays of the present application may also be of a specific color or plurality of colors. In one embodiment, the visual display assumes a color or colors of the structure to be imitated as would typically be found in nature. For example, the rock 12 may be of a grayish hue, the coral 16 may be brownish in color with tints of red, and the vegetation 23 may be a shade of green. In another embodiment, the visual display may assume a color or multiple colors not typically found in nature. For example, the rock may be a bright blue, the coral a deep purple, and the vegetation a bright red not found in any natural environment. Multiple colors may also be used when the visual display is being used to create a scenic element or underwater mural. Although specific shapes, sizes and colors of visual displays have been identified with respect to FIG. 1, one of skill in the art will not be so limited, as visual displays having various combinations of shapes, sizes and colors can be created.

Figure 2:
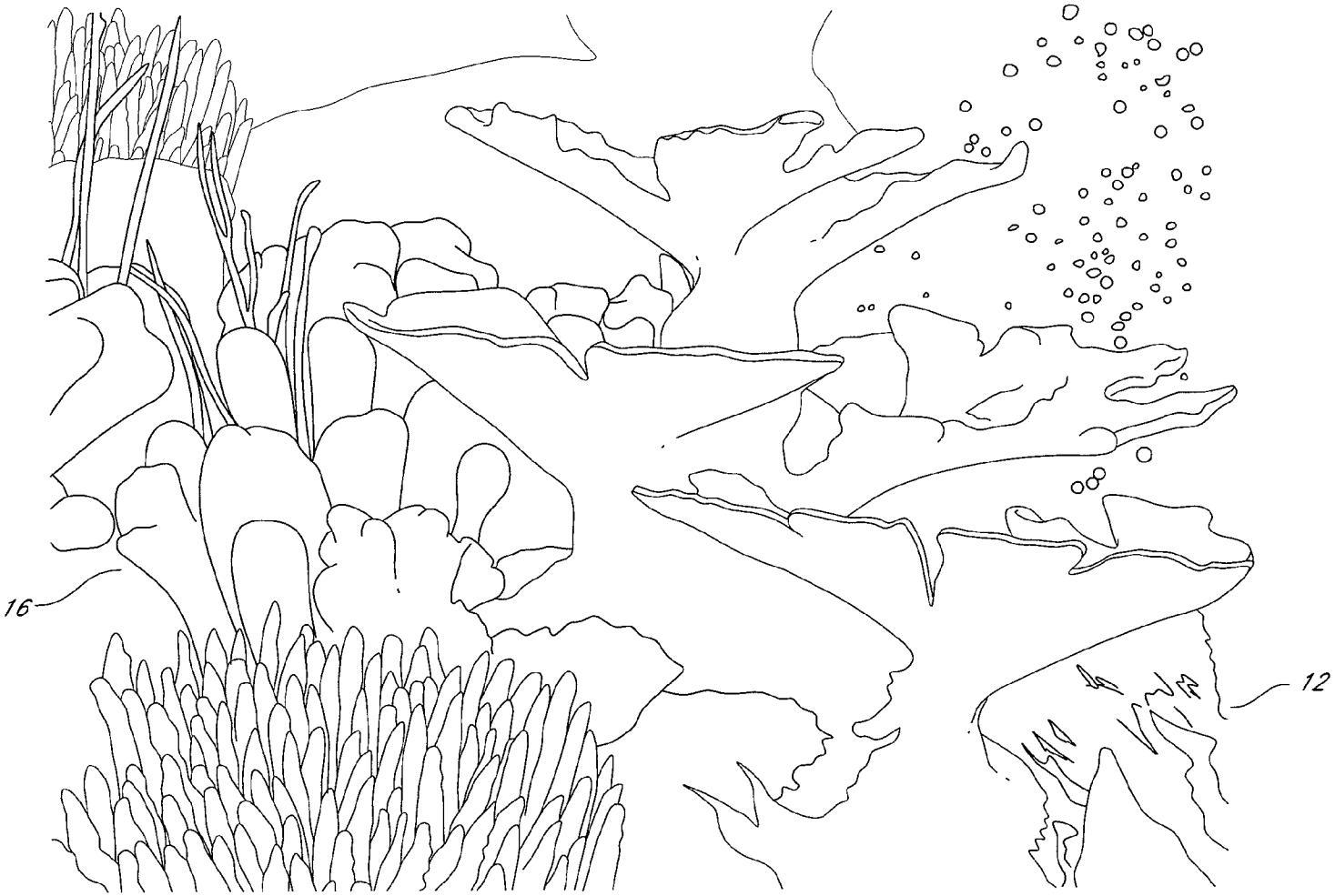
FIG. 2 illustrates a schematic view of a man-made lagoon having visual displays designed to imitate vegetation, rock and coral in an underwater, chlorinated environment.

FIG. 2 illustrates a schematic view of an outdoor man-made lagoon having a plurality of visual displays according to one embodiment of the application in an underwater environment. Like the visual displays of FIG. 1, the visual displays of FIG. 2 include a plurality of imitated rocks 12, coral 16, and vegetation 23 in different shapes, sizes and colors. The visual displays of FIG. 2 are located outdoors and underwater, and will experience constant exposure to sunlight through the water. In one embodiment, the underwater visual displays of the present application will be able to withstand color fading caused by exposure to sunlight. In another embodiment, the underwater visual displays will be able to withstand color fading caused by exposure to a chlorinated environment. In a preferred embodiment, the underwater visual displays will be able to withstand both fading caused by high exposure to sunlight and exposure to chlorine.

According to one embodiment, to create a visual display with a fade resistant surface, crushed glass particles are applied to the surface of a base. The term "crushed glass particles" is used to describe any glass that may derive from a large, bulk glass piece by chipping, pulverizing, crushing or machining the large glass piece into smaller pieces. Once the glass has been crushed, the glass may be ready for use to create a visual display. The glass may be attached to the base surface using a fastener device, such as a miniature anchor. In a preferred embodiment, the crushed glass particles are applied and attached to the surface of a base using a natural or synthetic binder, such as an epoxy.

Although the crushed glass particles may be painted various colors so as to replicate a naturally occurring structure, in a preferred embodiment, the crushed glass particles are not painted. Rather the visual displays of the present application will rely on the intrinsic color of the crushed glass particles to replicate a desired color of the structure to be imitated. By being intrinsically colored, the crushed glass will not fade when exposed to sunlight and chlorination.

Figure 3C:
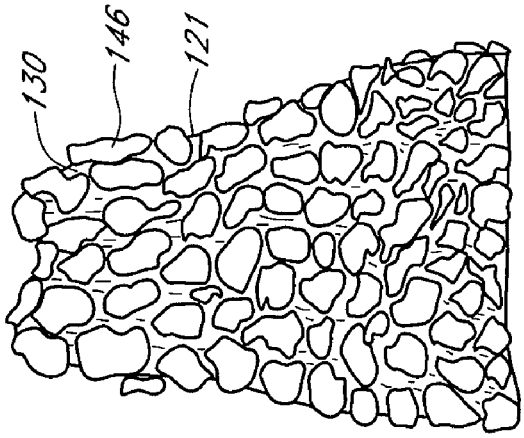
FIG. 3C illustrates a front view of the cement base of FIG. 3B according to one embodiment of the present application after colored, crushed glass particles have been applied to the epoxy.
Figure 3B:
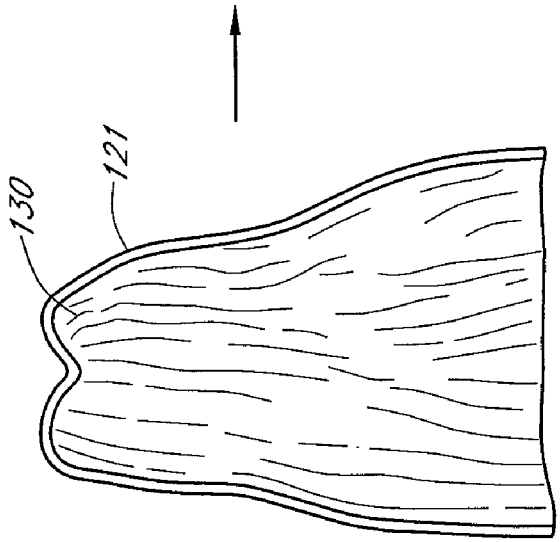
FIG. 3B illustrates a front view of a surface of the cement base of FIG. 3A according to one embodiment of the present application after epoxy has been applied to the base.
Figure 3A:
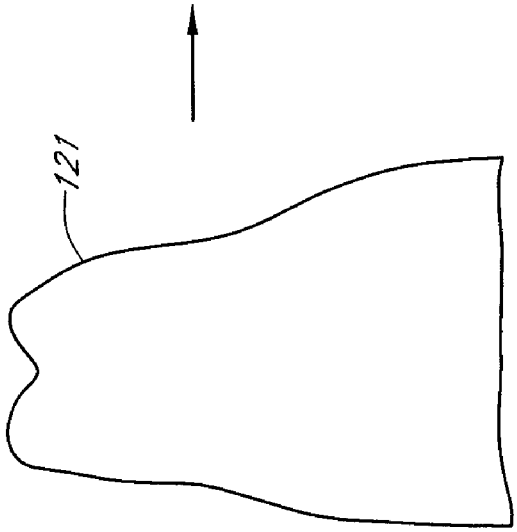
FIG. 3A illustrates a front view of a surface of a cement base according to one embodiment of the present application.

FIGS. 3A-3C illustrate a sequence of one embodiment of the present application in which a visual display imitating a piece of coral is created by applying crushed glass particles to a rock base using an epoxy adhesive. FIG. 3A illustrates a front view of a three-dimensional base 121 upon which epoxy and crushed glass particles will be subsequently applied. The base 121 is comprised of cement. In alternative embodiments, the base may be a rock base comprised of limestone, iron, silicon, calcium and other naturally occurring minerals. In other embodiments, the base may be made of concrete or an alternative material suitable for underwater use.

The base 121 is shaped like the structure to be imitated. For example, in one embodiment and as shown in FIG. 3A, the base is shaped like a piece of coral. The shape of the base will depend on the natural structure to be imitated. For example, the base 121 may assume the shape of coral, vegetation or other naturally occurring structures. In one embodiment, a shaped base may be created from a larger base that may be cut or grinded into a specific shape. In an alternative embodiment, the base 121 is selected from a plurality of pieces that already assume a desired shape of the structure to be imitated and no further cutting or grinding is required. In this embodiment, one skilled in the art need only select a base having a desired three-dimensional shape to use as part of a visual display. For embodiments that use a base made of cement, a base of a specific shape may be sculpted by applying cement over an underlying pre-shaped structure made of, for example, steel rods.

The base 121 may also assume various sizes. In one embodiment, the base 121 assumes a size as is typical for a naturally occurring structure. Alternatively, the base may be of a much larger or smaller size than is as typically found for a naturally occurring structure.

FIG. 3B illustrates a front view of a surface of the base 121 according to one embodiment after epoxy 130 has been applied to the base. The epoxy 130 serves as a binder to attach decorative materials, such as crushed glass particles, to the base 121. In another embodiment, besides serving as a binder for decorative particles, the epoxy may also serve as a sealer for the base 121. In yet another embodiment, the epoxy 130 may serve as a primer before additional layers of epoxy are applied over the base 121. One skilled in the art will appreciate that many different kinds of primers and sealers, besides epoxy, may be used if desired before applying epoxy to the base.

The epoxy 130 may be a high performance solid epoxy, a water based epoxy, a non-water based epoxy, an epoxy hybrid, or any other epoxy suitable for underwater use. In a preferred embodiment, the epoxy 130 is a high solids epoxy which has no volatile organic compounds (VOCs). Such an epoxy may be purchased under the brand name Rust-Oleum®. The epoxies used may be comprised of various chemicals and combinations thereof. For example, in one embodiment, an epoxy comprised of less than 85.0 wt % bisphenol a/epichlorohydrin epoxy resin and 20.0 wt % furfuryl alcohol is used. In another embodiment, an epoxy comprised of less than 10.0 wt % diethylenetriamine, 10.0 wt % tetraethylenepentamine (tepa), 5 wt % phenol, 4,4'-(1-methylethylidene)bis, and 5.0 wt % benzyl alcohol is used. Other epoxies composed of different chemical combinations may also be used and one skilled in the art should not be limited to any specific type of epoxy, so long as the epoxy is suitable for use above and below water.

The epoxy 130 may be applied to the base 121 by using an instrument such as a brush or spray. In a preferred embodiment, the epoxy 130 may be applied to the base 121 by a hand broadcasting method, in which layers of epoxy are thrown onto a surface of the base. In one embodiment, the epoxy 130 is spread generously over the surface of the base 121, such as by the hand broadcasting method mentioned above. In another embodiment, the epoxy 130 is applied only to specific areas of the base, such as by using a brush. In yet another embodiment and as shown in FIG. 3B, layers of epoxy 130 are applied to the base. When multiple layers of epoxy are created, the layers may be discreet without overlapping. In another embodiment, the epoxy layers overlap with each other such that multiple layers of epoxy 130 are formed above one another on the surface of base 121.

The epoxy may be a colored epoxy with pigments dispersed throughout the epoxy, such as for example, black, white, red, yellow, blue, brown and green pigments. By using colored epoxy, epoxy layers may be used for decorative purposes in the visual displays. In a preferred embodiment, the epoxy is a clear epoxy that is not pigmented. By using a clear epoxy, the epoxy will serve primarily as an adhesive binder rather than as a decorative material. In a preferred embodiment, the epoxy that is used is clear and does not blush or amber over time in any environment.

In one embodiment, the epoxy 130 may be a thermoplastic epoxy that may be melted and reformed upon heating. In another embodiment, the epoxy 130 may be a thermosetting epoxy that may cure only when exposed to a threshold temperature. If the epoxy is a thermosetting epoxy, materials such as crushed glass pieces may be added to the epoxy before the threshold temperature is reached and before the epoxy is irreversibly hardened. The time for the epoxy to set and harden may vary depending on the composition of the epoxy, as well as the temperature and other environmental conditions. For example, under full sun exposure in outdoor conditions, a high solid epoxy as described above may harden in approximately thirty minutes. The crushed glass particles 146 placed in unhardened epoxy 130 form a composition that can be designed or molded to assume different surface features (both smooth and rough) of an object to be imitated. Upon the hardening of the epoxy 130, a textured composition of crushed glass particles and epoxy is created that will be fade resistant and which will alleviate many of the problems associated with the prior art.

FIG. 3C illustrates a front view of the base 121 after crushed glass particles 146 have been applied to the base using the epoxy 130 as an adhesive binder. As noted previously, the term "crushed glass particles" is used to describe any glass that may be derived from a large, bulk glass piece by chipping, pulverizing, crushing or machining the large glass piece into smaller pieces. The crushed glass particles may adhere to the surface of the base 121 using the epoxy 130 and may assume the shape of the underlying base layer so as to imitate the form of a naturally occurring structure.

In one embodiment, the crushed glass particles 146 are applied to the base layer 121 and epoxy 130 by using a mechanical instrument, such as a hopper gun with a screen. In a preferred embodiment, the application of crushed glass particles 146 to the base 121 with epoxy 130 will be done by hand. The skilled artisan will appreciate that the glass particles 146 may be selected and placed by an instrument or by hand in specific locations based on the size and color of the glass particles so as to create a visual display that imitates a naturally occurring structure and its surface features. For example, to create a visual display that imitates a natural piece of coral, as in FIG. 3C, the crushed glass particles 146 may be placed on a base of a desired shape to form a rough surface having a combination of polyps and wrinkles.

In one embodiment, layers of epoxy 130 and crushed glass 146 may be applied repeatedly to the base surface 121, such that an epoxy-glass layer may overlie a previously deposited epoxy-glass layer. For example, a layer of epoxy may be applied, followed by hand-placement of crushed glass particles, followed by another layer of epoxy, and then an additional layer of crushed glass particles. By applying multiple layers of epoxy and crushed glass particles to the base, a visual display can be recreated having textured and uneven surface features. In some cases, applying multiple layers of epoxy and crushed glass may also make colors on the surface of the visual display more evenly distributed. Alternatively, crushed glass particles can be applied to the base without a pre-application of epoxy to the base, such as by applying epoxy or other adhesive first to the crushed glass particles, or applying epoxy and the crushed glass particles simultaneously. In one embodiment, the overall thickness of the epoxy layers 130 having crushed glass particles 146 will be between about ⅛ and 1 inch. In a preferred embodiment, the overall thickness of the epoxy layers and crushed glass particles will be between about ¼ and ½ of an inch.

The crushed glass particles 146 may be symmetrically shaped, for example, like a circle, oval, or triangle. In another embodiment and as shown in FIG. 3C, the crushed glass particles may have a body that is not symmetrical in any direction, and which cannot be identified as simply a circle, oval, triangle or other symmetrical shape. In a preferred embodiment, the visual display will be comprised of a combination of crushed glass particles that are both symmetrical and asymmetrical, so as to imitate particular features of the structure to be imitated.

The crushed glass particles may be of various sizes and of different thicknesses. The term "thickness" is used to refer to the largest cross-sectional length of the particle's build as measured in any single direction. The term thickness is therefore appropriate to both symmetrically and asymmetrically shaped particles, which may or may not have, for example, a diameter with which to measure the particle. In one embodiment, the glass particles may have a thickness of about 1 inch or less, such as between about 1/32 and ½ of an inch, and in a preferred embodiment, a thickness between about 1/16 and ⅛ of an inch. The skilled artisan will appreciate that the chosen size of the glass particles will vary depending on the features of the naturally occurring structure to be imitated.

The glass particles may be purchased directly from a crushed glass manufacturer. Such a manufacturer may sell readily available crushed glass of varying shapes, sizes and colors. In a preferred embodiment, the crushed glass particles, whether crushed by the skilled artisan or purchased from a manufacturer, will be comprised of recycled materials that are beneficial to the environment.

The crushed glass particles 146 may be of various colors, from clear to iridescent, and the choice of the colors will depend on the visual display of the natural structure to be imitated. In one embodiment, the glass may be clear and translucent. In a preferred embodiment, the glass may be intrinsically colored. Intrinsically colored glass may be created naturally or by synthetic processes that add minerals or purified metal salts to glass to give the glass a definite pigment. For example, the addition of iron (Fe) to glass in combination with other compounds can give the glass a reddish-blue color, while the addition of manganese (Mn) to glass can result in glass having a purple hue. While a supplier of glass may have only a limited number of glass colors available, the skilled artisan will appreciate that different color combinations may be created by mixing available glass colors, such that a palette of over 90 colors may be readily available for use in creating a visual display. The crushed glass particles used for the visual display may therefore be selected from a plurality of colors, and may be placed in a specific arrangement and assume the shape of the underlying base to imitate a naturally occurring structure. Using colored glass in the present application allows for the creation of a visual display that is both visually stimulating and fade resistant in a multitude of environments.

Figure 4:
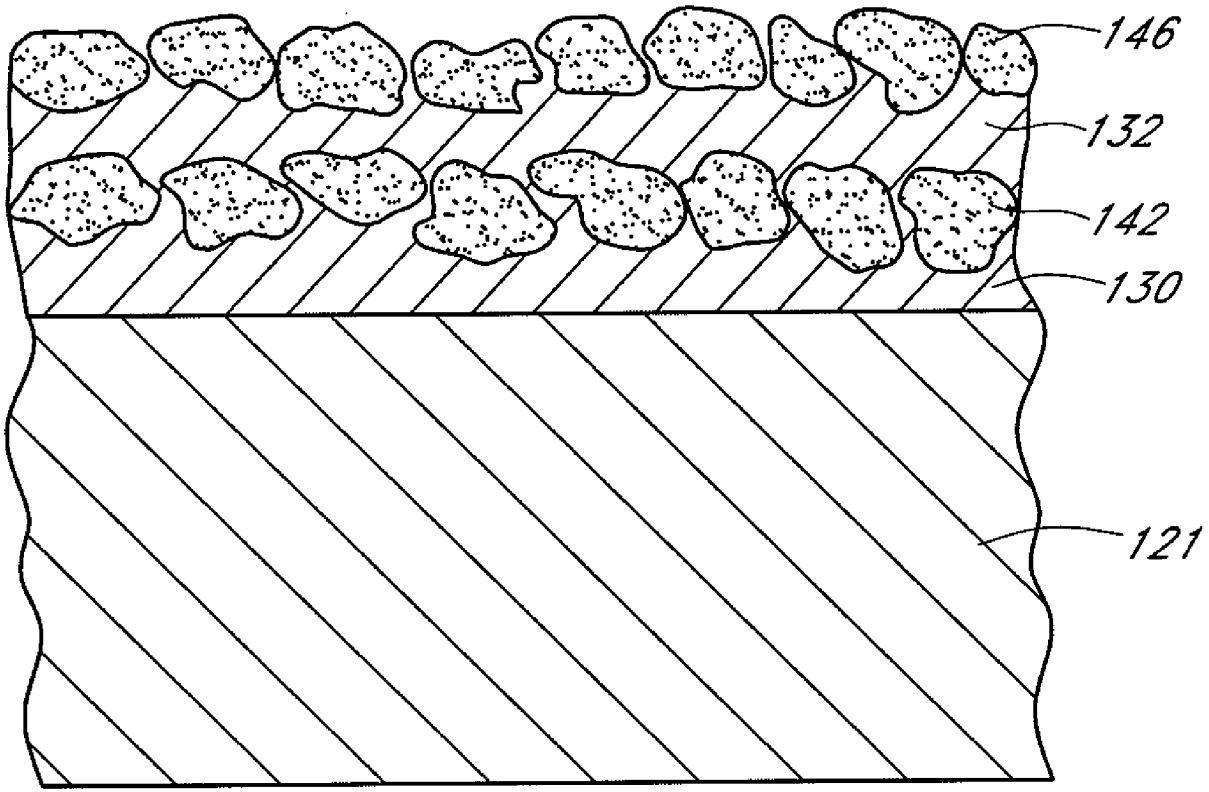
FIG. 4 illustrates a cross-sectional view of a visual display structure according to one embodiment of the present application.

FIG. 4 illustrates a cross-sectional view of a visual display structure according to one embodiment of the present application. The visual display includes a base 121 and multiple layers of epoxy 130 and 132 used as a binder for a plurality of crushed glass particles 142 and 146.

As seen in FIG. 4, a layer of epoxy 130 may be applied over a base 121 using any of the methods described above. A first set of crushed glass particles 142 may be placed within the layer of epoxy 130 in various locations before the epoxy settles and hardens. Preferably, the crushed glass particles 142 will be placed in the epoxy layer 130 immediately after the layer is applied to the base 121. In one embodiment, once epoxy layer 130 is allowed to harden, a second layer of epoxy 132 may also be applied over the crushed glass particles 142. A second set of crushed glass particles 146 may then be applied to the epoxy layer 132. Additional layers of epoxy and crushed glass particles may further be applied, depending on the needs of the skilled artisan.

In one embodiment, the particles 142 and 146 in the aggregate may be arranged to resemble a naturally occurring structure. Within the layers of epoxy 130 and 132, the crushed glass particles 142 and 146 may be placed proximate to one another. While some of the crushed glass particles 142 and 146 may touch one another, other glass particles may not touch any particle. Moreover, as seen in FIG. 4, glass particles may be placed such that one glass particle may be placed above another, for example, after a second layer of epoxy is applied over a first.

The crushed glass particles may be distributed throughout the epoxy in various positions such that the crushed glass particles assume a shape of the underlying base and create a unique visual display structure that gives the visual appearance of a naturally occurring structure such as coral or snow. The crushed glass particles may also be distributed throughout the epoxy to create a visual display structure, such as a mosaic or mural, that depicts both naturally occurring and artificial structures and environments. The visual display structure may serve as a decorative item which can be used, for example, as part of an attraction at a theme park. The visual display structure may be placed completely above water or completely below water. In one embodiment, the visual display comprises a base with epoxy and crushed glass particles, the base being partially exposed to an underwater, chlorinated environment. Even when the visual display structure is submerged in part or completely underwater, in one embodiment, it is possible for an observer to view the display either above or below water.

Although the foregoing application has been described in terms of certain preferred embodiments, other embodiments will be apparent to those of ordinary skill in the art, in view of the disclosure herein. Accordingly, the present application is not intended to be limited by the recitation of the preferred embodiments, but is instead to be defined by reference to the appended claims.

What is claimed is:

1. A method of imitating a natural underwater structure in a chlorinated environment, the method comprising:

providing a base in a desired shape of the natural underwater structure to be imitated;

applying epoxy to the base to serve as a binding material;

after applying epoxy, placing crushed glass particles in the epoxy, wherein the crushed glass particles are selected from a plurality of colors arranged to imitate the natural underwater structure, the crushed glass particles assuming the shape of the underlying base; and exposing at least a part of the base with epoxy and crushed glass particles to an underwater, chlorinated environment.

2. The method of claim 1, wherein the crushed glass particles comprise recycled, crushed colored glass having a thickness between about 1/16 and 1/8 inches.

3. The method of claim 1, wherein the epoxy is a colorless epoxy comprised of bisphenol a/epichlorohydrin epoxy resin and furfuryl alcohol.

4. The method of claim 1, wherein the epoxy and crushed glass particles are applied in a layer having a thickness of up to about 1 inch.

5. The method of claim 1, further comprising applying epoxy and crushed glass particles in layers.

6. The method of claim 1, wherein the crushed glass particles are distributed throughout the epoxy so as to create a visual appearance of coral.

7. The method of claim 1, wherein the base is cement.

8. A method of creating an underwater display, comprising:

providing a base having a desired three-dimensional shape;

adhering crushed glass particles to the base by the selection of specific glass particles to be adhered to specific locations on the base, wherein the crushed glass particles are selected from a plurality of colors arranged to imitate a natural underwater structure; and exposing at least a part of the base with crushed glass particles to an underwater environment.

9. The method of claim 8, wherein the crushed glass particles are adhered to the base using epoxy.

10. The method of claim 8, wherein the crushed glass particles are applied to the base in a layer.

11. The method of claim 8, wherein the natural underwater structure is selected from the group consisting of coral, rock, and algae.

12. An underwater display imitating a natural underwater structure, the display comprising:

a base in a desired shape of the natural underwater structure to be imitated;

a layer of epoxy applied over the base as a binder; and a plurality of crushed glass particles applied to the epoxy, wherein the crushed glass particles are selected from a plurality of colors arranged to imitate the natural underwater structure and assume the shape of the underlying base to imitate the natural underwater structure.

13. The underwater display of claim 12, further comprising water wherein at least a part of the base with epoxy and crushed glass particles are submerged within the water.

14. The underwater display of claim 13, wherein the water is chlorinated.

15. The underwater display of claim 12, wherein the crushed glass particles have a plurality of colors selected and arranged to imitate and assume the shape of coral.

16. The underwater display of claim 12, wherein the crushed glass particles have a plurality of colors selected and arranged to imitate and assume the shape of underwater vegetation.

17. The underwater display of claim 12, wherein the crushed glass particles are applied as a layer over the base having a thickness of less than about 1 inch.

18. A method of producing a scenic element as part of a visual attraction, comprising:

providing a base having a desired three-dimensional shape; and adhering crushed glass particles to the base by the selection of specific glass particles to be adhered to specific locations on the base, wherein the crushed glass particles are selected from a plurality of colors arranged to produce a desired scenic element.

19. The method of claim 18, wherein the scenic element imitates a naturally occurring structure.

20. The method of claim 18, wherein the scenic element imitates a manmade structure.

* * * * *